United States Patent [19]

Uchida et al.

[11] Patent Number: 4,890,824

[45] Date of Patent: Jan. 2, 1990

[54] RECIRCULATION-TYPE BILL RECEIVING AND DISPENSING MACHINE

[75] Inventors: Shinya Uchida, Chigasaki; Akira Hirata, Kawagoe; Eiichi Yoshikawa, Hasuta, all of Japan

[73] Assignee: Laurel Bank Machines Co., Ltd., Tokyo, Japan

[21] Appl. No.: 136,379

[22] Filed: Dec. 22, 1987

[30] Foreign Application Priority Data

Dec. 24, 1986 [JP] Japan ..... 61-313634

[51] Int. Cl.[4] ..... B07C 5/34; B65H 29/12

[52] U.S. Cl. ..... 271/3.1; 271/6; 271/7; 271/279; 209/534

[58] Field of Search ..... 194/206, 207; 271/279, 271/298, 9, 3.1, 4, 6, 7, 301, 303; 209/534; 235/379, 380, 381

[56] References Cited

U.S. PATENT DOCUMENTS

| | | | |
|---|---|---|---|
| 4,465,925 | 8/1984 | Goi | 209/534 X |
| 4,510,380 | 4/1985 | Uchida et al. | 194/206 |
| 4,511,794 | 4/1985 | Imamichi | 235/379 |
| 4,697,708 | 10/1987 | Goto et al. | 209/534 |
| 4,744,468 | 5/1988 | Goi et al. | 209/534 |

FOREIGN PATENT DOCUMENTS

| | | | |
|---|---|---|---|
| 54-54097 | 4/1979 | Japan . | |
| 57-209591 | 12/1982 | Japan . | |
| 59-27385 | 2/1984 | Japan . | |
| 8203287 | 9/1982 | World Int. Prop. O. | 209/534 |

*Primary Examiner*—Joseph J. Rolla
*Assistant Examiner*—Edward S. Ammeen
*Attorney, Agent, or Firm*—Fleit, Jacobson, Cohn, Price, Holman & Stern

[57] ABSTRACT

A circulation-type bill receiving and dispensing machine reuses received bills for dispensing. It has a bill receiving and dispensing port and operating section at both sides of the machine. The bill receiving and dispensing machine includes separate bill discriminating sections each of which is arranged on each received-bill transferring route of the bill receiving and dispensing ports of the two sides for the exclusive use of that port. Thus the bill receiving and dispensing machine of the present invention can be operated at the same time from both sides. Accordingly, a customer can deposit bills at any time even if the machine is being operated in the bill receiving mode by the teller.

1 Claim, 9 Drawing Sheets

RECIRCULATION-TYPE BILL RECEIVING AND DISPENSING MACHINE

BACKGROUND OF THE INVENTION

The present invention relates to a bill receiving and dispensing machine and more particularly to a circulation-type bill receiving and dispensing machine adapted to reuse received bills as bills for dispensation and having a set of a bill receiving and a bill dispensing port at one side (e.g. the teller's side) and an operating section at the other side (e.g. the customer's side) of the machine body.

Bill receiving and dispensing machines have been used in banks where they are loaded with bills for dispensation before the start of transactions. In such a case, it is preferable to have a minimum amount of previously loaded bills so as to improve the money circulation efficiency. Thus, there has been recently developed a circulation-type bill receiving and dispensing machine which can reuse the received bills as bills for dispensation.

In a conventional bill receiving and dispensing machine, a set of a bill receiving and a bill dispensing port and an operation section is arranged only at one side of the machine body and thus exchange of bills between a teller and a customer must be done over the counter of the bank. This is very troublesome and also lowers the efficiency of the banking operation.

For avoiding these problems, there has been developed a bill receiving and dispensing machine which is provided with a set of a bill receiving and a bill dispensing port and an operating section at both the front side (e.g. teller's side) and the rear side (e.g. customer's side) and which is able to carry out the bill receiving and dispensing operations from both the front and rear sides of the machine body.

Such a bill receiving and dispensing machine having a set of a bill receiving and a bill dispensing port and an operating section on both sides (e.g. the teller's side and the customer's side) is disclosed, for example, in Japanese laid-open patent publications Nos. 27385/1984, 54097/1979 and 209591/1982.

The bill receiving and dispensing machine disclosed in Japanese laid-open patent publication No. 27385/1984 has a bill receiving and dispensing port, an operating section and a bill transferring route communicating with the bill receiving and dispensing port which are arranged at one side of the machine body and a bill receiving and dispensing port and an operating section arranged at the other side of the machine body. In this bill receiving and dispensing machine, a discriminating section, a bill containing section and a bill temporary pooling section are commonly used for bill withdrawal operations carried out via the bill receiving and dispensing ports at the two sides.

The machine disclosed in Japanese laid-open patent publication No. 54097/1979 relates to a transaction machine to be arranged at a teller's window and the machine disclosed in Japanese laid-open patent publication No. 209591/1982 relates to an automatic bill receiving and dispensing machine wherein a set of a bill receiving and a bill dispensing port and an operating section is arranged at both front and rear sides of the machine body. However, similarly to the machine disclosed in Japanese laid-open patent publication No. 27385/1984, this machine is also designed that only one discriminating section is commonly used for bill transaction operations carried out by both the bill receiving and dispensing ports.

In many cases the bill receiving and dispensing machine is simultaneously operated by a customer at one side and by a teller at the other side. However, according to the machines of the prior art, it is impossible to simultaneously carry out bill receiving or dispensing operations at the customer side and the teller side, since the bill receiving and dispensing machines of the prior art are so designed that they have a single bill discriminating section to be commonly used for bill dealing operations at the customer side and the teller side and therefore the bill discriminating section is occupied during bill transaction operations at either side. Accordingly, a customer cannot withdraw bills while the machine is being operated in the bill receiving mode by a teller and thus the customers must wait until the operation at the teller side is completed.

SUMMARY OF THE INVENTION

It is an object of the present invention to provide a bill receiving and dispensing machine which can be simultaneously operated at a customer side and a teller side.

According to the present invention, there is provided a circulation-type bill receiving and dispensing machine which reuses received bills as bills for dispensing and has a set of a bill receiving and bill dispensing port and an operating section at each side of the machine body characterized in that the bill receiving and dispensing machine includes separate bill discriminating sections each of which is arranged on a received-bill transferring route that communicates with the respective bill receiving and dispensing port and which is for the exclusive use of the said bill receiving and dispensing port.

The bill receiving and dispensing machine of the present invention includes separate bill discriminating sections each independently provided on a received-bill transferring route that communicates with each bill receiving and dispensing port at each side of the machine body. Thus it is possible to simultaneously operate the bill receiving and dispensing machine from both sides thereof even if the operation at one side is a bill receiving operation which requires bill discrimination.

BRIEF DESCRIPTION OF THE DRAWINGS

Other objects and advantages of the present invention will become apparent from the following detailed description of preferred embodiments of the present invention made with reference to the accompanying drawings in which.

DESCRIPTION OF THE PREFERRED EMBODIMENTS

Figure 1:
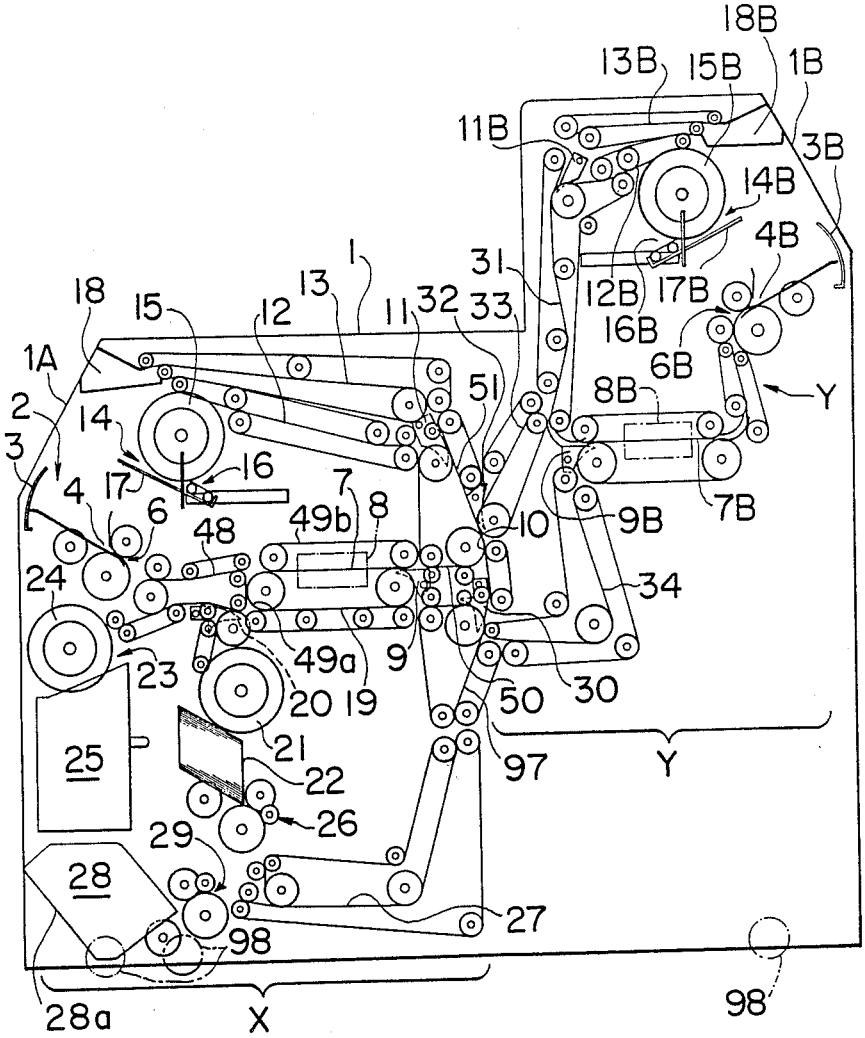
FIG. 1 is a side view schematically showing the construction of the bill receiving and dispensing machine of the present invention.
Figure 2:
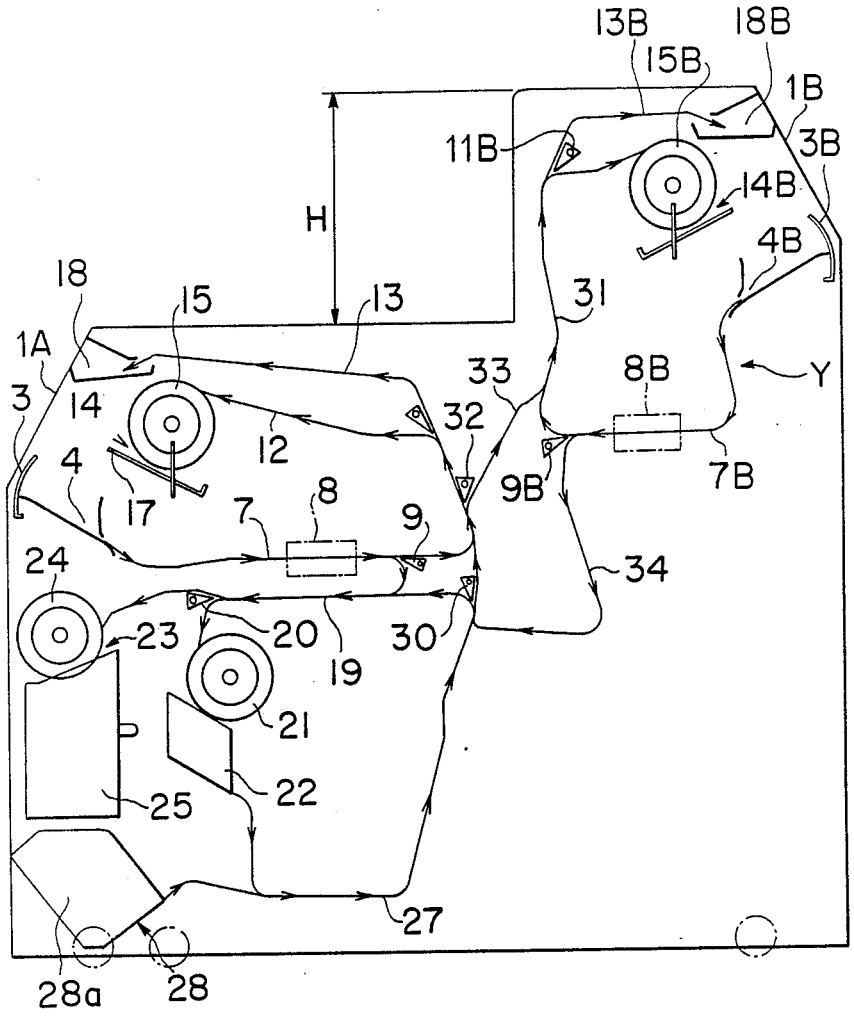
FIG. 2 is a view showing the flowpath of bills in the bill receiving and dispensing machine of FIG. 1.

The bill receiving and dispensing machine shown in FIGS. 1 and 2 is specifically for circulating and reuse for dispensing of 10,000.- yen bills. The machine shown is provided with a set of a bill receiving and bill dispensing port 4 and an operating section (not shown) for controlling the processing of bill receiving and dispensing operations at one side (left-hand side in FIG. 1) and is also provided with the another set of a bill receiving and bill dispensing port 4B and an operating section (not shown) at another side (right-hand side in FIG. 1) of a machine body 1. Each received bill transfer route communicating with each of the bill receiving and dispensing ports 4, 4B is provided with a bill discriminating section 8, 8B which is exclusively used for each port 4, 4B.

The bill receiving and dispensing machine is usually installed so that one bill receiving and dispensing port 4 is toward a teller side and the other port 4B toward a customer side. Thus, most of the main mechanisms such as bill containing and pooling mechanisms are arranged within the area on the teller side, and only those mechanisms involved with the customer operations are arranged within the area on the customer side, increasing the flexibility of design of the machine body 1 on the customer side to meet the requirements of individual banks.

The operating section of each side is for performing indications of amounts by denomination, total amounts, providing instructions to start and confirm, and to return bills, and usually comprises a display section and a keypad section. The display and keypad sections are arranged on panels 1A, 1B each of which form a part of the machine body 1 near the ports 4A, 4B. However, the arrangement of the operating section is not limited to such a style. For example, the operating section may be contained in a box separately from the machine body 1. In this case, the operating section may be composed of a CRT, a keypad, a card-reader, and the like.

First, the teller side mechanism X will be described with reference to the drawings.

When an order to intake bills is given, a shutter 3 of a transaction section 2 provided on the machine body 1 is opened to expose the bill receiving and dispensing port 4. When bills are inserted into the transaction section 2, the bills are pressed by a bill pressing mechanism 5 (FIG. 3) at an appropriate pressure and transferred one by one by a received-bill transfer mechanism 6 to a discriminating section 8 through a discriminating route 7. The discriminated bills are guided into a common route 10 by a first fork 9.

Bills discriminated as genuine at the discriminating section 8 are guided by a second fork 11 into an accumulating route 12. Bills discriminated as non-genuine are guided into a reject route 13. The genuine bills on the accumulating route 12 are continuously accumulated on a support plate 17 forming one part of an accumulating and transfer mechanism 16 through a temporary pooling wheel 15 of a bill delivery means 14 until the discrimination of all received bills is completed. The bills on the reject route 13 are fed to a reject port 18.

When the discrimination operation is completed, the bills accumulated on the support plate 17 are transferred to a position above the bill receiving and dispensing port 4 and dropped thereon, for retransfer to the discriminating route 7 by the received-bill transfer mechanism 6. Bills discriminated as 10,000.- yen bills at discriminating section 8are guided into a bill receiving route (received-bill route) 19 by the first fork 9 and then fed into a circulating-bill pooling means 22 by a third fork 20 via an accumulating wheel 21 for recirculating bills. Bills other than 10,000.-yen bills are guided into a received-bill containing means 23 by the third fork 20 and into a received-bill box 25 through an accumulating wheel 24.

When an order to dispense bills is made, the 10,000.-yen bills are fed to a bill dispensing route (dispensation bill route) 27 from the circulating-bill pooling means 22 by a circulating-bill feeding-out means. 26. Bills other than 10,000.- yen bills, for example, 1,000.- yen bills or 5,000.-yen bills, are loaded beforehand in a dispensation bill box 28*a* of a dispensation bill containing means 28 and fed out by a dispensation bill feeding-out mechanism 29 to the bill dispensing route 27. During these operations, any abnormalities are checked for, such as folded-over bills. When an abnormality is found, the bills concerved are returned to the received bill box 25 of the received-bill containing means 23 by a fourth fork 30, the bill receiving route 19 and the third fork 20. When no abnormality is found, the bills are guided to the common route 10 by the fourth fork 30 and then by the second fork 11 to the accumulating route 12. The bills on the accumulating route 12 are then continuously accumulated on the support plate 17 by the temporary pooling wheel 15. After the accumulation thereon of the desired amount of money, the bills on the support plate 17 are dropped onto the bill receiving and dispensing port 4 by driving the accumulating and transferring mechanism 16. Finally, by opening the shutter 3, the teller can take out the bills from the port 4.

"Received-bill transferring route" means a route for transferring the received bills to the circulating-bill pooling means 22 or the received-bill containing means 23, and in the present embodiment comprises a plurality of conveyor-belt routes and forks.

The customer side mechanism Y will be now be described with reference to the drawings.

The customer side mechanism Y includes several mechanisms which are similar to the teller side mechanisms and are symmetrically arranged with respect to the teller side mechanisms. These similar mechanisms will be designated by the addition of B to the reference numerals used with respect to the teller side mechanism.

The customer side mechanism Y comprises a dealing port means having a shutter 3B for opening and closing a bill receiving and dispensing port 4B, a received-bill transfer mechanism 6B, a discriminating route 7B, a discriminating section 8B, a first fork 9B, a second fork 11B, an accumulating route 12B, a reject route 13B, a bill delivery means 14B, temporary pooling wheel 15B, an accumulating and transferring mechanism 16B, a supporting plate 17B and a reject port 18B. Each of these mechanisms or members is the same as the corresponding are on the teller side.

In the customer side mechanism Y, the first fork 9B and the second fork 11B are connected by a common route 31. The route 31 is connected to the common route 10 of the teller side via a dispensing bill switching fork 32 and customer side dispensing route 33. A customer side bill receiving route 34 is arranged at the output-side of the customer side discriminating route 7B. The bill receiving route 34 is adapted to receive bills that have passed through the customer side discriminating route 8B via the first fork 9B and transfer them to the teller side bill receiving route 19.

The bills received into the bill receiving and dispensing port 4B on the basis of a bill receive order from the customer side operating section are discriminated similarly to the process used on the teller side and then fed into the customer side bill receiving route 34 via the discriminating route 8B again after confirmation of the amount of the received bills by the customer and are finally housed in the teller side circulating-bill pooling section 22 or the received-bill containing box 25 via the teller side bill receiving route 19.

When a customer orders bills to be dispensed, the required amount of bills are fed from the teller side circulating-bill pooling section 22 and the dispensation bill box 28*a*. These bills are fed into the customer side dispensation bill route 33 from the teller side dispensation bill route 27 via the switching fork 32 and then guided to the customer side accumulating route 12B via the customer side second fork 11B and finally fed out into the bill receiving and dispensing port 4B via the customer side bill delivering means 14B.

Since the customer side mechanism Y is independent from the teller side mechanism X, the height of the customer side mechanism Y relative to the teller side mechanism X can be selected appropriately For example, the embodiment shown is a "high-counter" type wherein the customer side is higher than the teller side by an amount "H" (FIG. 2). However, the machine can be a "low-counter" type wherein the customer side is lower than the teller side.

According to the present invention, the bill discriminating sections 8 and 8B are arranged on the received bill transferring route (discriminating route) in communication respectively with the bill receiving and dispensing ports 4 and 4B so that they can be used exclusively for the corresponding bill receiving and dispensing ports 4 and 4B. This makes it possible to carry out a bill receiving operation, which requires bill discrimination, via the ports 4, 4B on the customer and teller sides at the same time without interrupting the operation of either.

The details of main components included within the machine body 1 will be hereinafter described with reference to the teller side mechanism.

Figure 3:
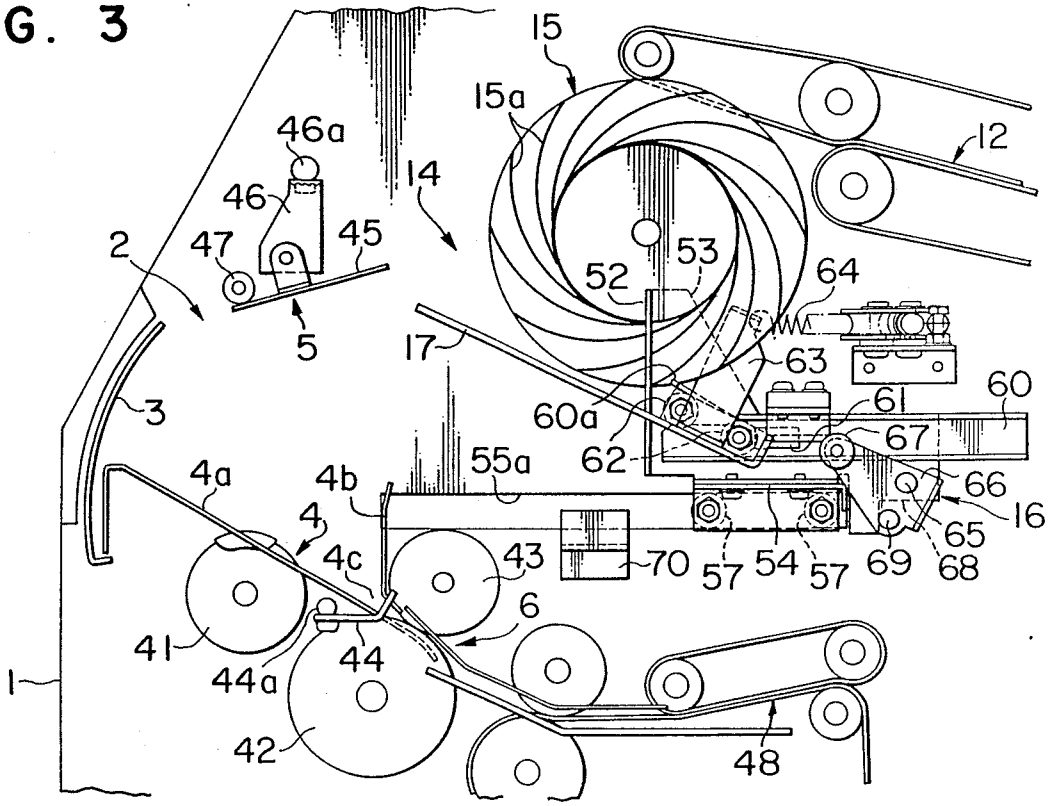
FIG. 3 is a partially enlarged view showing a bill delivery means used in the machine of FIG. 1.

With reference to FIG. 3, the bill receiving and dispensing port 4 of the transaction section 2 comprises a supporting plate 4*a* descending from the shutter 3 and a vertical plate 4*b* by which the ends of the accumulated bills on the supporting plate 4*a* are trued up. An opening 4*c* for feeding out the bills is formed between these plates 4*a* and 4*b*.

Also, as shown in FIG. 3, the received-bill transfer mechanism 6 comprises a roller 41 for advancing bills one by one, from the lowermost, to the opening 4*c*, a roller 42 for taking the advanced bills into the machine, a roller 43 arranged opposite the roller 42 in a state of non-rotation relative to the roller 42 or which rotates in a direction opposite to that of the feeding of the bills in order to prevent bills being fed two at a time, and a member 44 which normally maintains the opening 4*c* closed to align the ends of the lowermost bills and opens the opening 4*c* by pivotting around a support shaft 44*a* to permit the bills to pass therethrough.

The bill pressing mechanism 5 acts to assist the bill inception operation at the transaction port means 2 and comprises a pressing plate 45 pivotably suspended from a support member 46 which in turn is mounted on a shaft 46*a* that is vertically movable to lower the pressing plate 45 so as to press the upper surface of the bills when the bills are taken into the machine. However, except when the machine is in a bill inception operation, the pressing plate 45 is kept in an upper standby position away from the port 4 and inclined by a positioning member 47 in order to prevent interference with the bill transfer motion of the bill delivery means 14 which will be hereinafter described.

The discriminating route 7 is arranged behind the received-bill transfer mechanism 6 through an inception section 48 which receives the bills fed out one by one and transfers them to transfer belts 49A and 49B. These transfer belts 49A and 49B sandwich the bills horizontally therebetween and transfer them to the discriminating section 8 where the genuineness, denomination, and number of bills are discriminated.

As shown in FIG. 1, the common route 10 comprises a horizontal transfer section 50 provided as an extension of the discriminating section 7 and an elevating transfer section 51 which guides the bills upward. The accumulating route 12 and the rejecting route 13 are arranged downstream of the elevating transfer section 51 past the second fork 11.

As shown in FIG. 3, the bill delivery means 14 connected to the accumulating route 12 is positioned diagonally upward from the transaction section 2 and comprises the temporary pooling wheel 15 for which has vanes 15*a* for receiving the bills fed from the accumulating route 12 one by one therebetween and the accumulating and transferring mechanism 16 which drops bills onto the port 4 which have been received and accumulated on the support plate 17.

The accumulating and transfer mechanism 16 includes scraper members 52 arranged vertically at both sides of the accumulating wheel 15 to scrape the bills from the vanes 15*a*, and the support plate 17 for accumulating the bills scraped and dropped from the vanes 15*a*. These scraper members 52 and the support plate 17 are moved horizontally by a driving mechanism which is constructed as follows.

Figure 4:
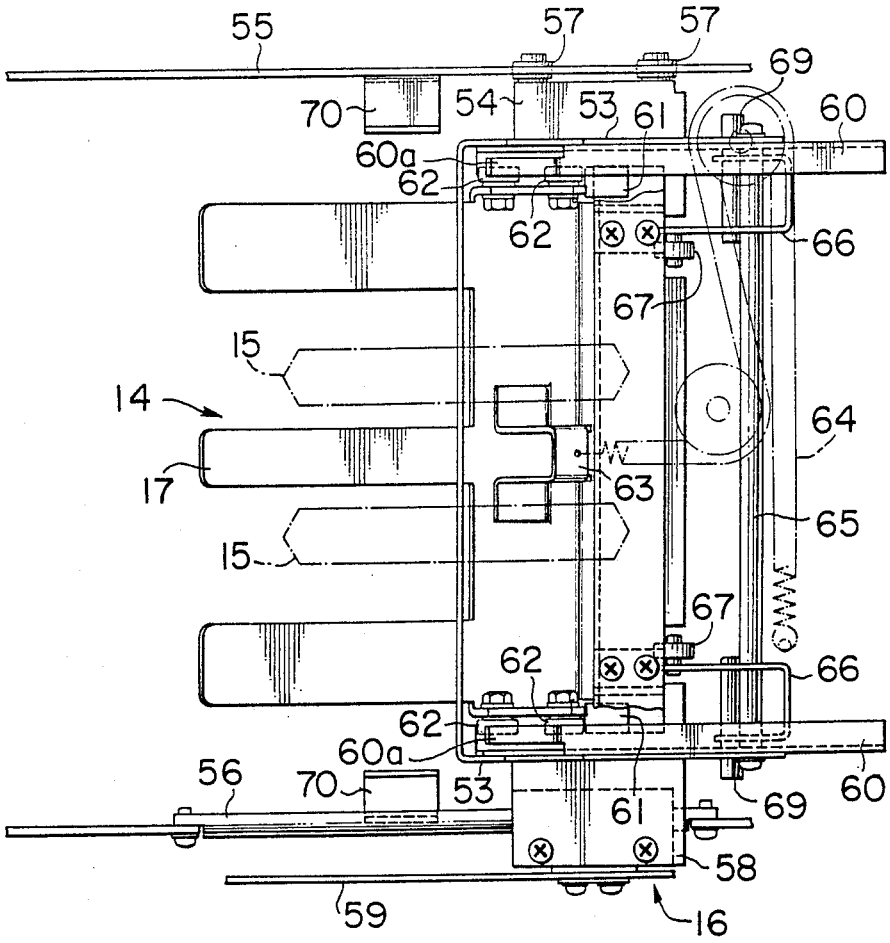
FIG. 4 is a plan view of the bill delivery means of FIG. 3.

With reference to FIGS. 3 and 4, side plates 53 are integrally formed on the back of each of the scraper members 52. A horizontal mounting plate 54 supporting the bottom of the side plates 53 extends between a horizontally elongated slot 55*a* formed in a support frame 55 for supporting the mounting plate 54 and a horizontal shaft 56 and is slidably supported on rollers 57. The mounting plate 54 has a drive block 58 secured thereto which is connected to a reversible driving motor (not shown) by a drive belt 59, so that the mounting plate 54 can be moved horizontally along the elongated slot 55*a* by the drive motor. The mounting plate 54 also has a pair of slide rails 60 secured thereon. Each of the slide rails 60 has a C-shaped cross-section and is arranged so that the channel sides face each other. The front end of each slide rail 60 has an upwardly inclined portion 60*a*. Stops 61 fixed on the machine body 1 project into the inside of each slide rail 60.

As best shown in FIG. 4, the front end of the supporting plate 17 is divided into a plurality of strips adapted to pass through notches (not shown) formed in the scraper members 52, and the base end of the support plate 17 is provided with guide rollers 62 that are in contact with the slide rails 60. There is also provided a spring 64 one end of which is secured to the machine body 1 and the other end to a support 63 which is secured to the base end of the support plate 17. The force of the spring 64 acting on the supporting piece 63 causes the support plate 17 to maintain its upwardly inclined condition as shown in FIG. 3 with the guide rollers 62 in contact with the upwardly inclined portion 60*a* of the slide rails 60 and the stops 61.

Each side plate 53 is provided with a pushing-out piece 66 pivotable around a shaft 65. Each pushing-out piece 66 is provided with a pushing-out roller 67 swingable in a space between the slide rails 60 with the pivotal motion of the pushing-out piece 66, and an engaging shaft 69 engageable with a notch 68 formed in each side plate 53. The pushing-out piece 66 is urged in clockwise direction (with respect to FIG. 3) by a spring (not shown). In FIG. 3 the engaging shafts 69 are shown in engagement with the notches 68 and the pushing-out rollers 67 are projected into the space between the slide rails 60 behind the stops 61 (on the right in FIG. 3).

An engaging member 70 is fixed horizontally on the machine body 1 at a position away toward the left (FIG. 3) of the engaging shaft 69 in engagement with the notch 68. The engaging member 70 abuts against the engaging shaft 69 and rotates the pushing-out piece 66 counter-clockwise around the shaft 65 so as to retract the pushing-out roller 67 from the space between the slide rails 60 when the pushing-out piece 66 is moved toward the left in FIG. 3 together with the scraper members 52 as explained below.

Referring again to FIG. 1, the bill receiving route 19 is formed by the lower belt 49A of the upper and lower transfer belts 49B and 49A forming the discriminating route 7 and another transfer belt 71 arranged opposite to the lower transfer belt 49A. The bills are sandwiched between the lower transferring belt 49A and the opposed transfer belt 71 and transferred in a direction opposite to that of the discriminating route 7.

The circulating-bill pooling means 22 which pools the bills distributed by the third fork 20 positioned behind the bill receiving route 19, separated by type of bill, is arranged at the center of the machine body 1. The received-bill containing means 23 is arranged at the front of the machine body 1. That is, they are arranged in series.

Figure 5:
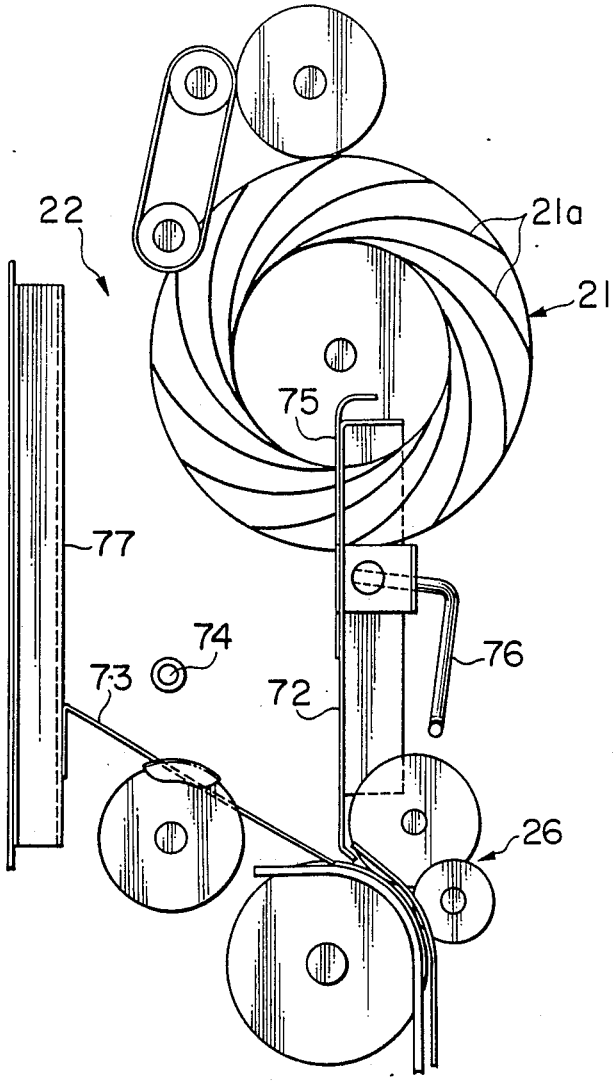
FIG. 5 is a side view of a circulating-bill pooling section used in the machine of FIG. 1.

As shown in FIG. 5, the circulating-bill pooling means 22 comprises the accumulating wheel 21 for circulating bills adapted to receive the bills one by one between its vanes 21*a*, a scraper member 72 arranged at both sides of the wheel 21, a supporting plate 73 for stacking the bills thereon with the ends of bills abutted against the scraper member 72, a sensor 74 for detecting the amount of bills on the support plate 73, and a pressing plate 75 for pressing the upper surface of the bills when the sensor 74 detects that the number of bills has become less than a predetermined number. The pressing plate 75 has an arm 76 secured to the back thereof. The arm 76 is rotated by a driving means (not shown) and, as shown in FIG. 5, is retracted from the upper area of the support plate 73 during accumulation of bills thereon. A vertical plate 77 closing the front side of the machine body 1 is formed with a closable opening (not shown) through which bills are inserted onto the support plate 73.

Figure 6:
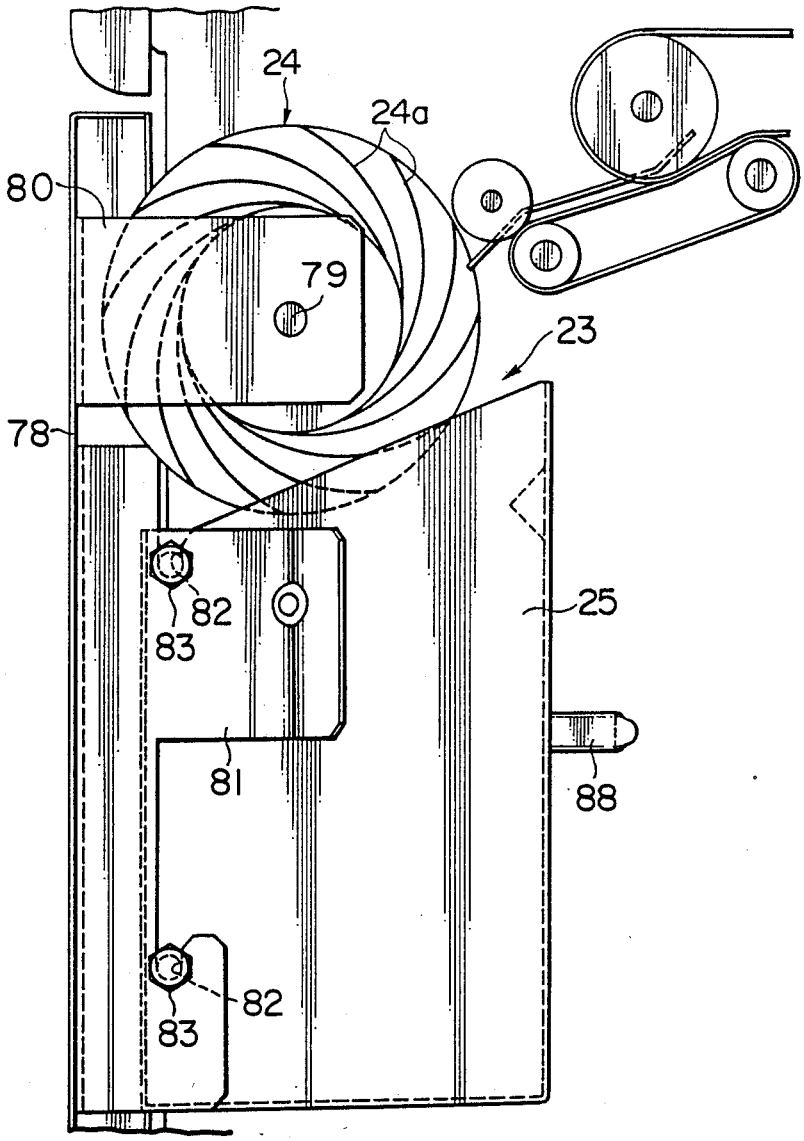
FIG. 6 is a side view of a received-bill containing means used in the machine of FIG. 1.

As shown in FIG. 6, the received-bill containing means 23 comprises the accumulating wheel 24 for housing received bills having vanes 24*a* adapted to receive bills one by one therebetween, and the received-bill box 25. The wheel 24 and the box 25 are mounted on a door 78 which is adapted to open the front of the machine body 1. A shaft 79 of the wheel 24 is rotatably supported by a bracket 80 secured to the door 78, and pins 83 of the box 25 are supported by notches 82 formed in a bracket 81 also secured to the door 78. Accordingly, by opening the door 78, both the wheel 24 and the box 25 can be drawn out from the machine body 1. Furthermore, the circulating-bill pooling means 22 is also exposed to the front of the machine body 1 wheen the door 78 is opened.

Figure 7:
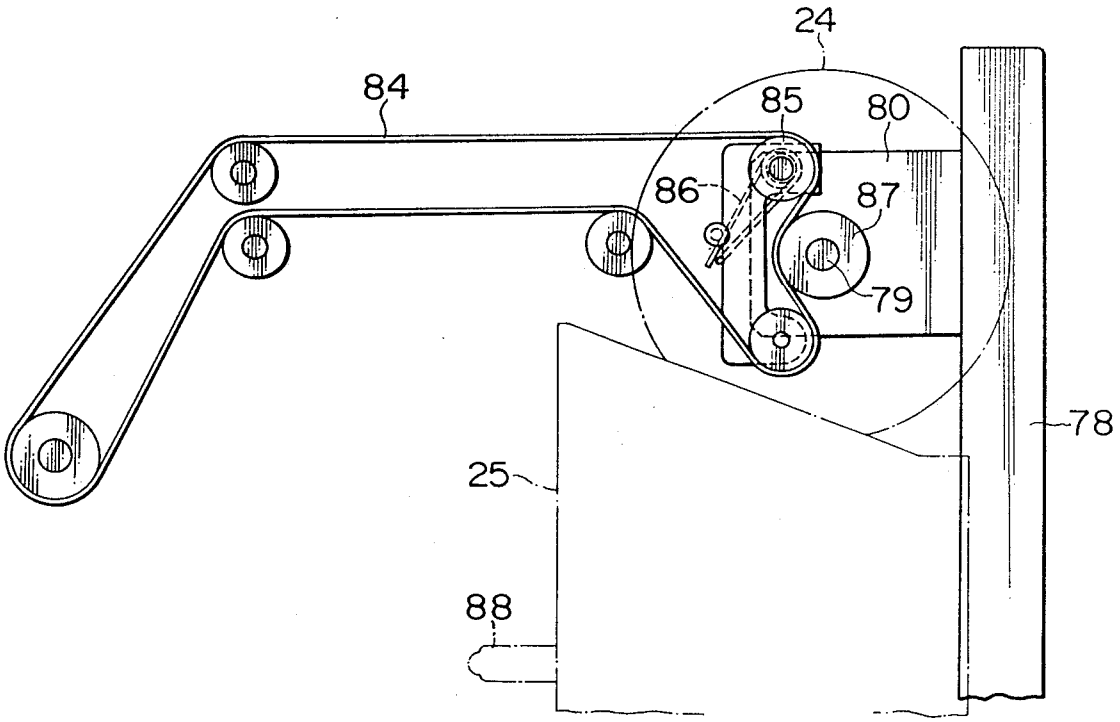
FIG. 7 is a side view showing the connection between an accumulating wheel for received bills and its driving means in the received-bill containing means of the machine of FIG. 1.

As shown in FIG. 7, the accumulating wheel 24 is driven by a driving means (not shown) mounted on the machine body 1 through a timing belt 84 which is tensioned by a tension pulley 85 under the urging of a spring 86. A drive roller 87 secured to the driving shaft 79 of the wheel 24 is adapted to engage with the timing belt 84 when the wheel 24 is mounted on the machine body 1. The received-bill box 25 is detachably mounted on the door 78 and is also provided with grips 88 to carry the box 25 separately from the door 78.

Figure 8:
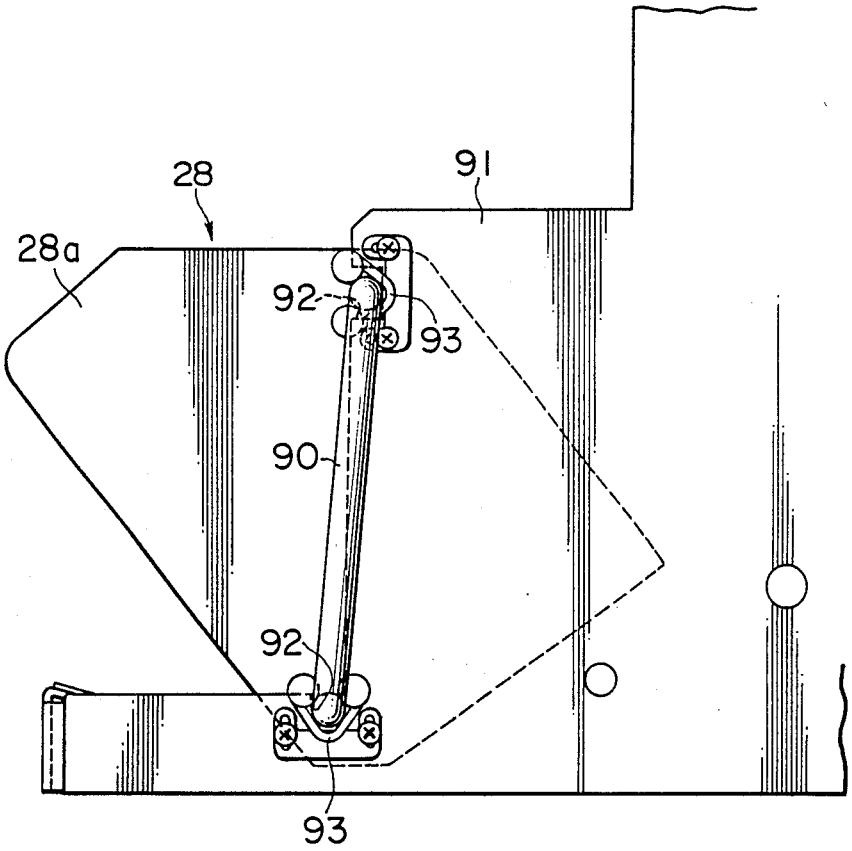
FIG. 8 is a side view of a dispensing bill containing means in which a dispensing bill box is attached to the machine body; and, FIG. 9 is an enlarged side view of the dispensing bill containing means of the machine of FIG. 1.

The dispensation bill containing means 28 is arranged below the box 25 (FIG. 1) and has a dispensing bill box 28*a* which houses the bills to be dispensed. As shown in FIG. 8, the box 28*a* has a U-shaped engaging lever 90 secured thereto and is adapted to be kept in an inclined condition when the engaging lever 90 engages with notches 92 formed in support frame members 91 spaced apart from each other. Joint members 93 are arranged near the notches 92 to hold the box 29*a* in an inclined condition with the joint members 93 snapped onto the lever 90.

Figure 9:
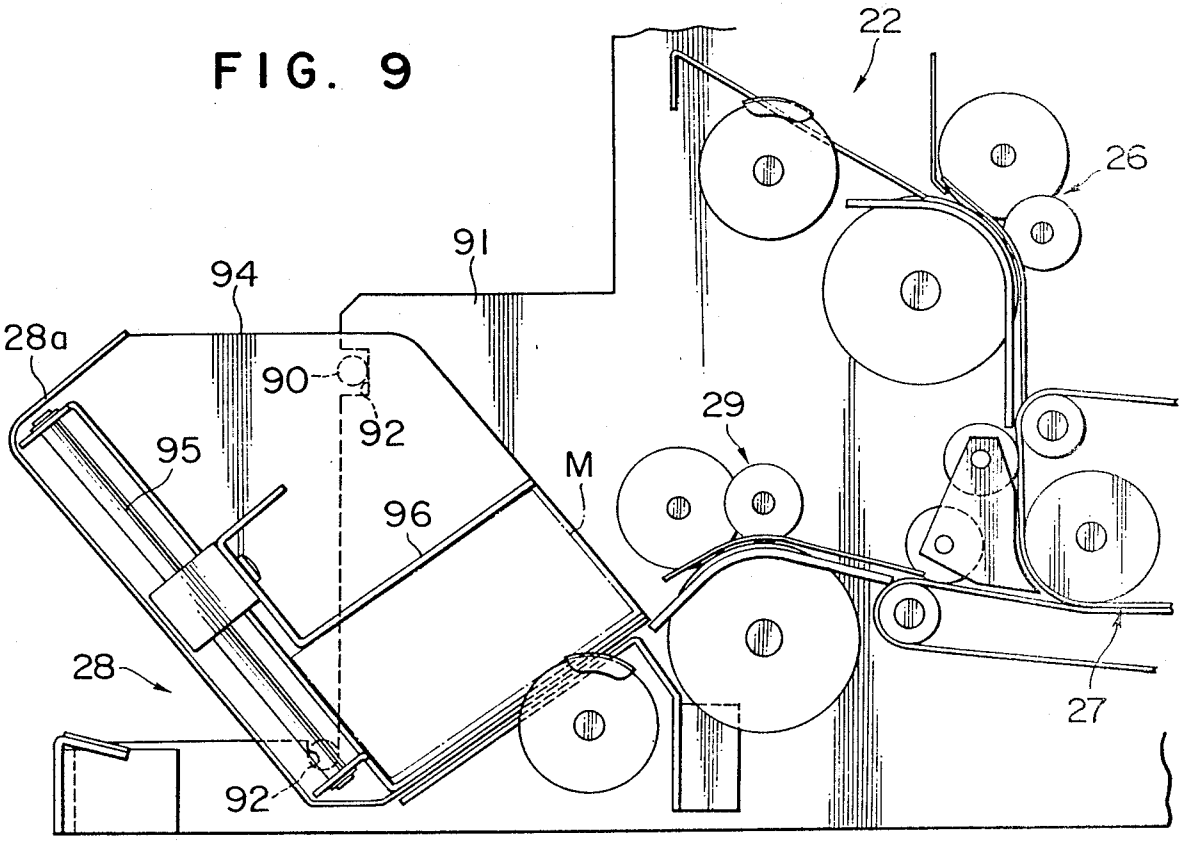

As shown in FIG. 9, the box 79 has an opening 94 extending over an area from the top to the rear of the box 28*a* and can be exposed to the outside of the machine body 1 when the box 28*a* is rotated counter-clockwise around the lower end of the lever 90. A guide shaft 95 is arranged within the box 28*a* for guiding a pressure plate 96. The pressure plate 96 can freely descend by gravity along the guide shaft 95 so as to constantly press the top surface of bills M to be dispensed in accordance with the amount of bills M contained within the box 28*a*.

As shown in FIG. 1, there are arranged, at the front end of the bill dispensing route 27, the circulating-bill pooling means 22, the circulating-bill feeding-out means 26 and the dispensation bill feeding-out mechanism 29. Also, there are arranged sensors (not shown) between the bill dispensing route 27 and the said means 22, 26 and 29 to detect the doubled bills and to count the number of bills for dispensing. At the rear end of the bill dispensing route 27, there is arranged a distribution transfer section 97.

The distribution transfer section 97 is connected to the front end of the elevational transfer section 51 of the common route 10 and the front end of the bill receiving route 19, and the bills for dispensation are fed out from the distributing transfer section 97 to either the common route 10 or the bill receiving route 19 by the fourth fork 30 arranged at a junction therebetween.

The numeral 98 in FIG. 1 denotes casters for moving the machine 1.

As stated above, the bill receiving and dispensing machine of the present invention for reusing 10,000.- yen bills among the received bills for dispensation circulates the 10,000.- yen bills through the circulating-bill pooling means 22. Bills other than 10,000.- yen bills together with bills during the transfer operation of which some abnormality occurred are housed within the received-bill box 25 of the received-bill containing means 23. 1,000.- yen bills are housed within the dispensation bill box 28*a* for dispensation. In the received bill distributing mode and the bill dispensing mode, the common route 10, the accumulating route 12, the bill delivery means 14 and the transaction section 2 are common.

According to the bill receiving and dispensing machine of the present invention, the received bills and the bills for dispensation are pooled within three sections, i.e. the circulating-bill pooling means 22, the received-bill containing means 23 and the dispensation bill containing means 28. Of these three sections, the received-bill containing means 23 is only for housing the bills, not for feed them out. Accordingly, the machine of the present invention makes it possible to eliminate the special bill pooling sections and the bill feeding-out mechanisms which are used in conventional machines of prior art. Furthermore, since the common route 10, the accumulating route 12, the bill delivery means 14 and the transaction section 2 are designed to be used in both the bill receiving and bill-denomination sorting mode and the bill dispensing mode, it is able to effectively utilize the space within the machine body 1 and therefore to enable the machine body 1 to be made compact, and especially enables the height of the machine body 1 to be reduced since the dispensation bill box 28*a* is arranged in an inclined condition relative to the machine body 1.

Furthermore, since the bills are dropped in a stacked condition from the supporting plate 17 onto the port 4 of the transaction section 2, a simple and sure dispensing operation is obtainable without need of a special clamping mechanism to hold the bills in a stacked condition.

Furthermore, bill unloading and operations are facilitated, since the circulating-bill pooling section 22 which automatically loads the bills during bill receiving operations is arranged at the center of the machine body 1 and the received-bill containing means 23 for housing bills and the dispensation bill containing means 28 for bill dispensing operations are arranged at the front of the machine body 1.

As may be clearly understood from the above description, according to the present invention, there is provided a circulation-type bill receiving and dispensing machine which reuses received bills for dispensing and has a set of a bill receiving and bill dispensing port and an operating section respectively at each side of the machine body characterized in that the bill receiving and dispensing machine includes separate bill discriminating sections each of which is arranged on a received-bill transferring route that communicates with the corresponding bill receiving and dispensing port of the particular side and which is for the exclusively use of that the bill receiving and dispensing port.

Thus the bill receiving and dispensing machine of the present invention can be operated at the same time from both sides. Accordingly, a customer can deposit bills at any time even if the machine is being operated in the bill receiving mode by the teller.

What we claim:

1. A circulation-type bill receiving and dispensing machine that reuses received bills as dispensation bills, said circulation-type bill receiving and dispensing machine comprising:

a single machine body;

a bill receiving and bill dispensing port and an operating section at each of two sides of said single machine body, one bill receiving and bill dispensing port and operating section at one side of said single machine body being for use by customers and the other bill receiving and bill dispensing port and operating section at the other side of said single machine body being for use by tellers, a received-bill transfer route communicating with each said bill receiving and dispensing port and having a separate bill discriminating section for the exclusive use of a respective bill receiving and dispensing port for simultaneously carrying out bill receiving or dispensing operations by both the customer and the teller through their respective bill receiving and dispensing port and operating section, and a single pooling section in direct communication with both of said bill receiving and bill dispensing ports for transferring bills to and for receiving bills from either of said bill receiving and bill dispensing ports.

* * * * *